United States Patent [19]

Kilsdonk

[11] Patent Number: 4,973,269

[45] Date of Patent: Nov. 27, 1990

[54] COMPRESSION SHIELD TERMINATION

[75] Inventor: Jan A. Kilsdonk, Corona, Calif.

[73] Assignee: McDonnell Douglas Corporation, Long Beach, Calif.

[21] Appl. No.: 494,438

[22] Filed: Mar. 16, 1990

[51] Int. Cl.[5] ..... H01R 13/648

[52] U.S. Cl. ..... 439/607; 439/275; 439/905

[58] Field of Search ..... 439/92, 98, 99, 607, 439/578, 275, 905, 583, 584, 609, 610

[56] References Cited

U.S. PATENT DOCUMENTS

| | | | |
|---|---|---|---|
| 3,110,756 | 11/1963 | Genung et al. | 174/78 |
| 3,154,632 | 10/1964 | Browne | 174/78 |
| 3,603,912 | 9/1971 | Kelly | 439/610 |
| 3,646,496 | 2/1972 | Williams | 439/610 |
| 3,652,782 | 3/1972 | Furusawa et al. | 174/73.1 |
| 3,739,076 | 6/1973 | Schwartz | 174/78 |
| 3,830,957 | 8/1974 | Oberdiear | 174/78 |
| 4,032,205 | 6/1977 | Taj | 174/78 |
| 4,243,290 | 1/1981 | Williams | 439/610 |
| 4,397,516 | 8/1983 | Koren et al. | 439/610 |
| 4,557,546 | 12/1985 | Dreyer | 439/584 |
| 4,693,323 | 9/1987 | Owensby | 174/35 C |
| 4,786,757 | 11/1988 | Owensby et al. | 174/78 |
| 4,921,449 | 5/1990 | Fish | 439/610 |

*Primary Examiner*—David L. Pirlot
*Assistant Examiner*—Julie R. Daulton
*Attorney, Agent, or Firm*—Ben J. Yorks; Gregory A. Cone; John P. Scholl

[57] ABSTRACT

A device for terminating a braided shield to a grounding connector, having a plate that pushes an elastomeric member into the braided shield, pressing the braided shield into the grounding connector, electrically grounding the shield to the connector. The plate and elastomer are attached to a shell, by either a plurality of pins or a retaining ring. The shell has an internal thread that mates with an external thread of the grounding connector, such that when the shell is screwed onto the connector, the plate pushes the elastomeric member into contact with the braided shield, creating an electrical contact between the shield and the grounding connector.

14 Claims, 1 Drawing Sheet

COMPRESSION SHIELD TERMINATION

BACKGROUND OF INVENTION

Bundled wrappped wires typically have metal braided shielding to protect the wires from outside electromagnetic interference (EMI). The braided shield is usually grounded to an electrical connector.

U.S. Pat. No. 3,603,912 by KELLY and U.S. Pat. No. 3,110,756 by GENUNG ET AL., disclose a structure that terminates the braided shield to a connector. Both Kelly and Genung essentially compress the end of the braided shield against the connector with a clamping ring. The shield and ring are retained and compressed by a nut that threads onto the connector.

The clamping ring is made of a rigid material which tends to fray the braided shield when the shield is compressed. The Kelly and Genung type terminations also have loose parts that must be individually inserted and secured when the shield terminator is assembled. Thus what is needed is a grounding shield terminator that provides reliable grounding between the braided shield and connector, that does not fray the shield and can be easily assembled.

SUMMARY OF INVENTION

This invention is a device for terminating a braided shield to a grounding connector, having a plate that pushes an elastomeric member into the braided shield, pressing the braided shield into the grounding connector, electrically grounding the shield to the connector. The plate and elastomer are attached to a shell, by either a plurality of pins or a retaining ring. The shell has an internal thread that mates with an external thread of the grounding connector, such that when the shell is screwed onto the connector, the plate pushes the elastomeric member into contact with the braided shield, creating an electrical contact between the shield and the grounding connector.

The pressure of the elastomeric member creates continuous electrical contact between the shield and connector. The terminator is constructed such that it is not susceptible to separation due to external forces such as vibration. The use of an elastomeric member reduces shield fraying that normally occurs with devices in the prior art. The shield terminator is one assembled piece that can be inserted and installed by simply twisting the shell. There is no separate installment of washers etc., as is done with present terminators.

Therefore it is an object of this invention to provide a shield terminator that does not fray a braided shield upon installation.

It is also an object of this invention to provide an assembled shield terminator that is installed as a unit, without separately inserting individual components of the terminator.

It is also an object of this invention to provide a single unit shield terminator that does not fray a braided shield and provides a reliable grounding of the braided shield to a grounding connector.

BRIEF DESCRIPTION OF THE DRAWINGS

The objectives and advantages of this invention will become more apparent to one skilled in the art after reviewing the following detailed description and drawings, wherein.

DETAILED DESCRIPTION OF THE INVENTION

Figure 1:
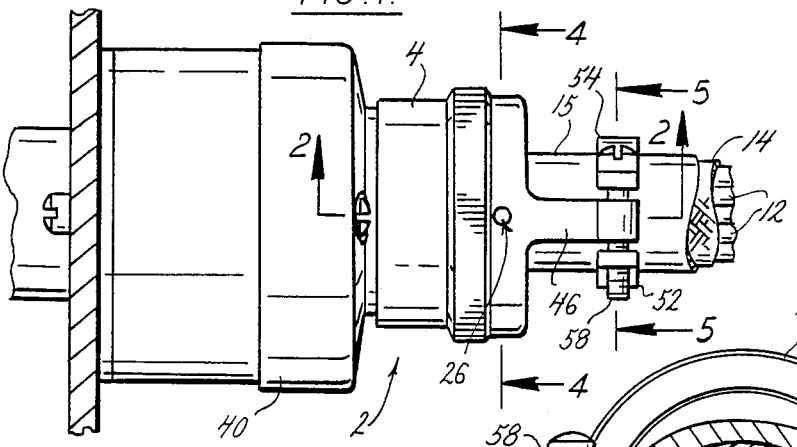
FIG. 1 is a side view of a shield terminator attached to a grounding connector.
Figure 2:
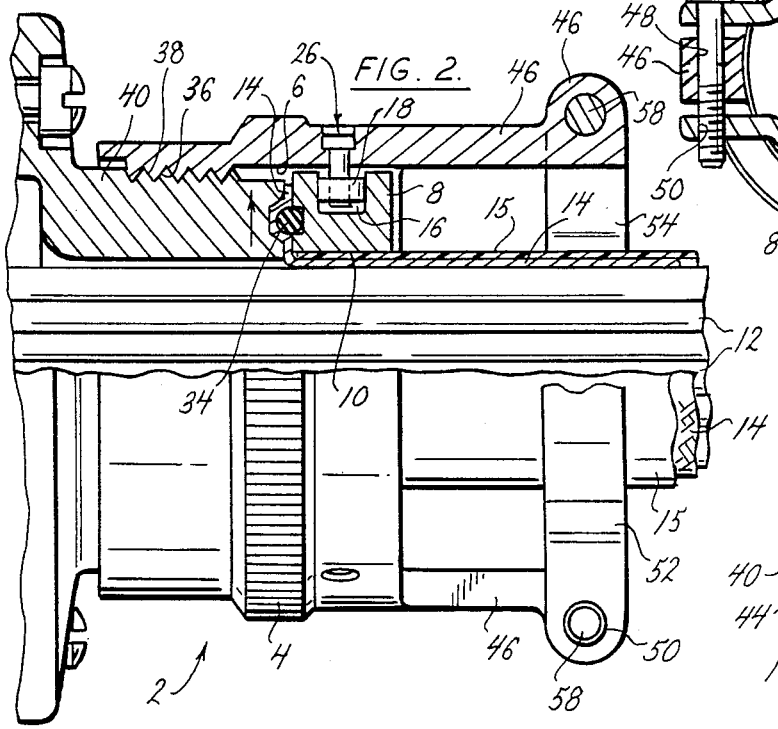
FIG. 2 is a sectional view of FIG. 1 taken at line 2—2, showing a braided shield electrically grounded to the grounding connector.

Referring to the drawings more particularly by reference numbers, number 2 in FIGS. 1 and 2 is a shield terminator 2 having a shell 4 with a first bore 6 extending through the longitudinal axis of the shell 4. A plate 8 fits within the first bore 6, the plate 8 having a second bore 10 extending through the longitudinal axis of the plate 8. The second bore 10 is of such a diameter to allow a bundle wrap of wires 12 with a braided shield 14 and jacket 15 to be inserted through the plate 8 and shell 4. The braided shield 14 can be a wire mesh typically used for electromagnetic interference (EMI) protection. The jacket 15 being an insulator typically used to 5 protect a bundle wrap of wires 12.

Figure 3:
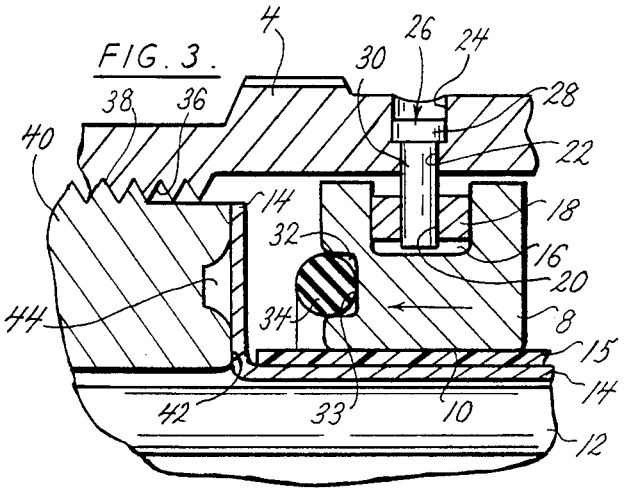
FIG. 3 is an enlarged view of FIG. 2, showing an elastomeric member before it presses a braided shield into the grounding connector.
Figure 4:
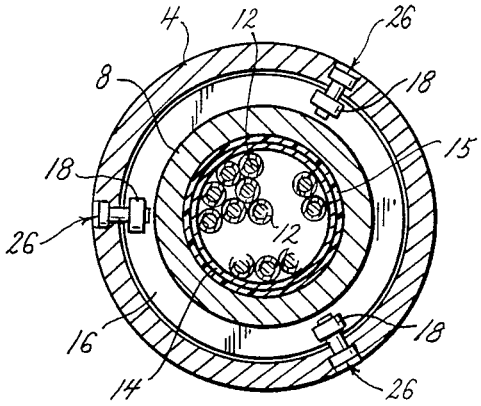
FIG. 4 is a sectional view of FIG. 1 taken at line 4—4, showing a 120° spacing of pins and bushings that attach a plate to the shell of the shield terminator.

The plate 8 has a retainer groove 16 around its circumference. Three bushings 18 fit within the retainer groove 16, each bushing 18 having a third bore 20 aligned with three first holes 22 in the shell 4, each first hole 22 having a counterbore 24, see FIG. 3. Three pins 26 having heads 28 and shanks 30, are inserted into the first holes 22. The heads 28 fit within the counterbores 24, the shank 30 of the pins fitting into the bushings 18, attaching the plate 8 to the shell 4. It being preferred that the pins 24 be press fitted into the first holes 22. As shown in FIG. 4, the pins 26 are spaced approximately 120° apart The plate 8 has a compression groove 32 in the contact surface 33 of the plate 8, which holds a first elastomeric member 34. The first elastomeric member 34 may be an O-ring or any other similar type elastomeric member.

The shell 4 has an internal thread 36 adapted to mate with an external thread 38 of an electrically conductive grounding connector 40. To install the shield terminator 2, the bundle wrap 12, braided shield 14 and jacket 15 are pulled through the first 6 and second 10 bore such that the wrap, shield and jacket extend through the plate 8. A portion of the shield 14 extends from the jacket 15 and is pressed against a grounding surface 42 of the connector 40, either manually or with a tool, see FIG. 3. The shell 4 is then screwed onto the connector 40, causing the shell 4 and attached plate 8 to move in the direction as indicated by the arrow in FIG. 3. The plate 8 pushes the first elastomeric member 34 into the shield 14, pressing the shield 14 and connector 40 together, electrically grounding the shield 14 to the connector 40. The grounding connector 40 may have a shield groove 44, of such size and shape to receive and retain the first elastomeric member 34, such that the shield and elastomer are not subject to translational movement as indicated by the arrow in FIG. 2.

Figure 5:
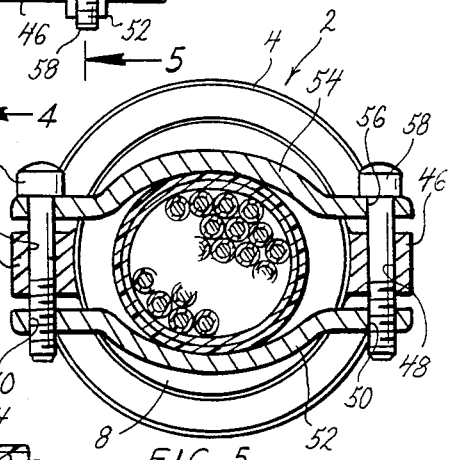
FIG. 5 is a sectional view of FIG. 1 taken at line 5—5, showing a harness clamp attached to the shell of the shield terminator.

The shell 4 may have a pair of flanges 46 with a pair of second holes 48 that align with a pair of threaded third holes 50 in a first clamp 52, see FIG. 5. A second clamp 54 has a pair of fourth holes 56 that align with the pair of second holes 48. The first 52 and second 54 clamps are attached to the flanges 46 by a pair of screws 58, inserted into the second, third and fourth holes. The clamps help support the bundle of wires and are typical in backshell connectors.

Figure 6:
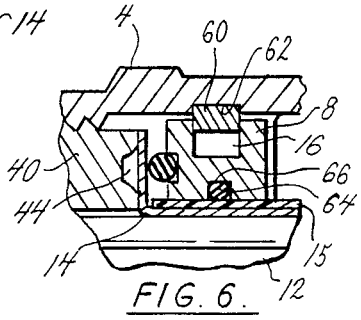
FIG. 6 is an enlarged sectional view similar to FIG. 3, showing an alternate embodiment wherein the plate is attached to the shell with a retainer ring and an O-ring environmentally seals the bundle of wires.

As an alternate embodiment, FIG. 6 shows a retaining ring 60 that may be used instead of the pins 26 and bushings 18. The ring 60 would fit within the retainer groove 16. The retaining ring 60 may be a "C-ring", with an outer diameter larger than the diameter of the first bore 10, such that the ring 60 would compress when the plate 8 is inserted into the shell 4 and expand or "snap" into an internal groove 62 in the shell 4, attaching the plate 8 to the shell 4.

In addition, a second elastomeric member 64 may be attached to the plate 8, that environmentally seals the bundle of wires 12. The second elastomeric member 64 may be an O-ring that fits within a seal groove 66 within the plate 8. The O-ring having an inner diameter smaller than the outside diameter of the jacket 15, such that when the jacket and bundle of wires are inserted through the plate 8, the second elastomer 64 presses against the jacket 15. The second elastomeric member 64 can be used with either the retaining ring 60 or the pin 26 and bushing 18 configuration.

While certain exemplary embodiments of this invention have been described above and shown in the accompanying drawings, it is to be understood that such embodiments are merely illustrative of, and not restrictive on, the broad invention. The invention is not to be limited by the specific constructions or arrangements shown and described, since various other modifications may occur to persons having ordinary skill in the art.

What is claimed is:

1. A grounding device for a bundle wrap of wires having a braided shield, wherein the braided shield is terminated to a grounding connector having an external thread and a grounding surface, comprising:

(a) a shell having a first bore through a longitudinal axis of said shell, a plurality of holes through said shell essentially perpendicular to said first bore, and an internal thread adapted to engage the external thread of the grounding connector;

(b) a plate adapted to reside within said first bore, said plate having a second bore through a longitudinal axis of said plate wherein the bundle wrap of wires and braided shield extend through said second bore, the braided shield is adapted to make contact with the grounding surface of the grounding connector, said plate having a retainer groove and a contact surface facing the grounding surface;

(c) a plurality of bushings adapted to fit within said retainer groove, said bushings having a third bore aligned with said holes of said shell;

(d) a plurality of pins extending through said holes of said shell and inserted into said bushings, said pins and said bushings attaching said plate to said shell;

(e) a first elastomeric member attached to said contact surface of said plate, whereby when said shell is screwed onto the grounding connector, said plate pushes said first elastomeric member into contact with the braided shield, pressing together the braided shield and the grounding connector.

2. The grounding device as recited in claim 1, wherein the grounding connector has a shield groove adapted to receive said first elastomeric member, when said shell is screwed onto the grounding connector.

3. The grounding device as recited in claim 1, further comprising a second elastomeric member attached to said plate within said second bore, and an external insulating jacket enclosing the braided shield and bundle wrap of wires, said second elastomeric member adapted to press against the external jacket when said bundle wrap of wires extends through said second bore.

4. The grounding device as recited in claim 1, wherein said holes have counterbores and said pins have heads adapted to fit within said counterbores.

5. The grounding device as recited in claim 1, wherein said first elastomeric member is an O-ring.

6. The grounding device as recited in claim 5, wherein said plate has a compression groove adapted to retain said O-ring.

7. The grounding device as recited in claim 6, wherein the grounding connector has a shield groove adapted to receive said O-ring, when said shell is screwed onto the grounding connector.

8. A grounding device for a bundle wrap of wires having a braided shield, wherein the braided shield is terminated to a grounding connector having an external thread and a grounding surface, comprising:

(a) a shell having a first bore through a longitudinal axis of said shell, an internal groove, and an internal thread adapted to engage the external thread of the grounding connector;

(b) a plate adapted to reside within said first bore, said plate having a second bore through a longitudinal axis of said plate wherein the bundle wrap of wires and braided shield extend through said second bore, the braided shield is adapted to make contact with the grounding surface of the grounding connector, said plate having a retainer groove and a contact surface facing the grounding surface;

(c) a retaining ring adapted to fit within said retainer groove and said internal groove, said retainer ring attaching said plate to said shell;

(d) a first elastomeric member attached to said contact surface of said plate, whereby when said shell is screwed onto the grounding connector, said plate pushes said first elastomeric member into contact with the braided shield, pressing together the braided shield and the grounding connector.

9. The grounding device as recited in claim 8, wherein the grounding connector has a shield groove adapted to receive said first elastomeric member, when said shell is screwed onto the grounding connector.

10. The grounding device as recited in claim 8, further comprising a second elastomeric member attached to said plate within said second bore, and an external insulating jacket enclosing the braided shield and bundle wrap of wires, said second elastomeric member adapted to press against the external jacket when said bundle wrap of wires extends through said second bore.

11. The grounding device as recited in claim 8, wherein said retaining ring is a C-ring.

12. The grounding device as recited in claim 8, wherein said first elastomeric member is an O-ring.

13. The grounding device as recited in claim 12, wherein said plate has a compression groove adapted to retain said O-ring.

14. The grounding device as recited in claim 13, wherein the grounding connector has a shield groove adapted to receive said O-ring, when said shell is screwed onto the grounding connector.

* * * * *